US008096344B2

(12) United States Patent
Wagstaff et al.

(10) Patent No.: US 8,096,344 B2
(45) Date of Patent: Jan. 17, 2012

(54) SEQUENTIAL CASTING OF METALS HAVING SIMILAR FREEZING RANGES

(75) Inventors: Robert Bruce Wagstaff, Spokane Valley, WA (US); Eric W. Reeves, Hayden Lake, ID (US); Wayne J. Fenton, Spokane Valley, WA (US); Jim Boorman, Greenacres, WA (US)

(73) Assignee: Novelis Inc., Toronto (CA)

( * ) Notice: Subject to any disclaimer, the term of this patent is extended or adjusted under 35 U.S.C. 154(b) by 193 days.

(21) Appl. No.: 12/462,224

(22) Filed: Jul. 30, 2009

(65) Prior Publication Data

US 2010/0025003 A1 Feb. 4, 2010

Related U.S. Application Data

(60) Provisional application No. 61/137,470, filed on Jul. 31, 2008.

(51) Int. Cl.
*B22D 11/00* (2006.01)
*B22D 11/049* (2006.01)
*B22D 11/124* (2006.01)

(52) U.S. Cl. ..... 164/461; 164/487; 164/444

(58) Field of Classification Search ..... 164/461, 164/419, 487, 444
See application file for complete search history.

(56) References Cited

U.S. PATENT DOCUMENTS

| | | | | |
|---|---|---|---|---|
| 3,206,808 | A * | 9/1965 | Robinson | 164/461 |
| 4,156,451 | A | 5/1979 | Getselev | |
| 4,355,679 | A | 10/1982 | Wilkins | |
| 4,388,962 | A | 6/1983 | Yarwood et al. | |
| 4,458,744 | A | 7/1984 | Yarwood et al. | |
| 4,567,936 | A * | 2/1986 | Binczewski | 164/453 |
| 5,148,856 | A * | 9/1992 | Mueller et al. | 164/487 |
| 5,685,359 | A | 11/1997 | Wagstaff | |
| 6,260,602 | B1 | 7/2001 | Wagstaff | |
| 6,705,384 | B2 * | 3/2004 | Kilmer et al. | 164/461 |
| 7,077,186 | B2 | 7/2006 | Bowles et al. | |
| 2005/0011630 | A1 * | 1/2005 | Anderson et al. | 164/461 |
| 2007/0215312 | A1 | 9/2007 | Gallerneault | |
| 2007/0215313 | A1 | 9/2007 | Wagstaff | |
| 2008/0008903 | A1 | 1/2008 | Lloyd et al. | |
| 2008/0202720 | A1 | 8/2008 | Wagstaff | |
| 2009/0056904 | A1 | 3/2009 | Wagstaff | |

FOREIGN PATENT DOCUMENTS

| | | | |
|---|---|---|---|
| DE | 44 20 697 | A1 | 12/1995 |
| WO | WO 02/40199 | A2 | 5/2002 |

OTHER PUBLICATIONS

Canadian Intellectual Property Office, International Search Report (Oct. 26, 2009) in Int'l Appln. No. PCT/CA2009/001077 (Novelis Inc. et al.).

* cited by examiner

*Primary Examiner* — Kevin P Kerns
(74) *Attorney, Agent, or Firm* — Cooper & Dunham LLP

(57) ABSTRACT

A method and apparatus are disclosed for sequentially direct chill casting a composite ingot made of metals having similar freezing ranges. Poor adhesion between the layers and low reliability of casting are addressed by adjusting the position of secondary cooling (created by applying water streams to the emerging ingot) relative to the upper surfaces of the molten metal pools compared to the conventional positions of first application of the secondary cooling. This can be achieved by moving one or more walls of the mold (when the secondary cooling emanates from the bottom of such walls), or adjusting the height of the molten metal pools within the mold and moving cooled divider walls between the pools. The relative temperatures and conditions of the metals at positions where they meet at the metal interface may therefore be optimized.

18 Claims, 6 Drawing Sheets

SEQUENTIAL CASTING OF METALS HAVING SIMILAR FREEZING RANGES

CROSS-REFERENCE TO RELATED APPLICATION

This application claims the priority right of prior provisional patent application Ser. No. 61/137,470 filed Jul. 31, 2008 by applicants herein.

BACKGROUND OF THE INVENTION (1) Field of the Invention

This invention relates to the casting of metals, particularly aluminum and aluminum alloys, by direct chill (DC) casting techniques. More particularly, the invention relates to the co-casting of metal layers by direct chill casting involving sequential solidification.

(2) Description of the Related Art

Metal ingots are commonly produced by direct chill casting of molten metals. This involves pouring a molten metal into a mold having cooled walls, an open upper end and (after start-up) an open lower end. The metal emerges from the lower end of the mold as a solid metal ingot that descends and elongates as the casting operation proceeds. In other cases, the casting takes place horizontally, but the procedure is essentially the same. Solidification of the ingot emerging from the mold is facilitated and ensured by directing streams of liquid coolant (normally water) onto the sides of the nascent ingot as it emerges from the mold. This is referred to as "secondary cooling" of the ingot (primary cooling is effected by the cooled mold walls). Such casting techniques are particularly suited for the casting of aluminum and aluminum alloys, but may be employed for other metals too.

Direct chill casting techniques of this kind are discussed extensively in U.S. Pat. No. 6,260,602 to Wagstaff, which relates exclusively to the casting of monolithic ingots, i.e. ingots made of the same metal throughout and cast as a single layer. Apparatus and methods for casting bi- or multi-layered structures (referred to as "composite ingots") by sequential solidification techniques are disclosed in U.S. Patent Publication No. 2005/0011630 A1 to Anderson et al. Sequential solidification relates to the casting of bi- or multi-layers and involves the casting of a first layer (e.g. a layer intended as an inner layer or "core") and then, subsequently but in the same casting operation, casting one or more layers of other metals (e.g. as outer or "cladding" layers) on the first layer once it has achieved a suitable degree of solidification.

U.S. Pat. No. 5,148,856 which issued to Mueller et al. on Sep. 22, 1992, discloses a casting mold provided with deflector means for deflecting the coolant streams in a variable direction depending on the local shrinkage conditions of the ingot being formed such that the coolant impinges on the ingot at a constant distance around the periphery of the ingot. The deflector means is preferably a movable baffle.

While these techniques are effective, difficulties may be encountered when attempting to employ the sequential solidification technique with certain combinations of alloys, particularly those having similar and, especially, overlapping freezing ranges on cooling from the molten state (i.e. overlapping ranges between the solidus and liquidus temperatures of the respective alloys). In particular, when such metals are sequentially cast, it is sometimes found that the cladding layer may not bond as securely to the core layer as would be desired, or the interface between the cladding and core layers may rupture or collapse during casting due to high contraction forces generated in the various layers.

There is therefore a need for improved casting equipment and techniques when co-casting metals of these kinds.

BRIEF SUMMARY OF THE INVENTION

One exemplary embodiment provides an apparatus for casting a composite metal ingot. The apparatus comprises an open-ended generally rectangular mold cavity having an entry end portion, a discharge end opening, cooled mold walls surrounding the mold cavity to form opposed side walls and opposed end walls of the mold, and a movable bottom block adapted to fit within the discharge end and to move axially of the mold during casting. At least one cooled divider wall is positioned at the entry end portion of the mold to divide the entry end portion into at least two feed chambers. Means are provided for feeding metal for an inner layer to one of the at least two feed chambers and there is at least one means for feeding another metal for at least one outer layer to at least one other of the feed chambers, to thereby form a generally rectangular ingot at the discharge end opening having opposed side surfaces and opposed end surfaces and comprising an inner layer and at least one outer layer. Secondary cooling equipment for the ingot is spaced from the discharge end opening in a direction of casting and is adapted to provide secondary cooling of each surface of the ingot emerging from the discharge end opening. The secondary cooling equipment has parts positioned to provide secondary cooling of each of the opposed side surfaces and the opposed end surfaces, at least one of the parts being movable in the direction of casting independently of at least one other of the parts. Means are provided for moving the at least one of the parts in the direction of casting.

The parts of the secondary cooling equipment are preferably configured to commence secondary cooling of both side surfaces of the emerging ingot at an effective distance from the discharge end opening of the mold that is different from the effective distance at which the secondary cooling of the end surfaces is commenced. The secondary cooling therefore lacks vertical alignment around the ingot, at least on one side surface. The parts of the secondary cooling equipment may be supported by adjacent side and end walls of the mold, and at least one of the side walls may be movable in the direction of casting relative to other walls of the mold. Alternatively, the parts of the secondary cooling equipment may be supported by adjacent side and end walls of the mold, and the opposed end walls are capable of being moved in the direction of casting relative to at least one side wall of the mold.

According to another exemplary embodiment, there is provided an apparatus for casting a composite metal ingot, comprising an open-ended generally rectangular mold cavity having an entry end portion, a discharge end opening, cooled mold walls surrounding the mold cavity to form opposed side walls and opposed end walls of the mold, and a movable bottom block adapted to fit within the discharge end and to move axially of the mold in a direction of casting. At least one cooled divider wall is provided at the entry end portion of the mold to divide the entry end portion into at least two feed chambers. A conduit is provided for feeding metal for an inner layer to one of the at least two feed chambers and at least one further conduit is provided for feeding metal for at least one outer layer to at least one other of the feed chambers, to thereby form a generally rectangular ingot at the discharge end opening having opposed side surfaces and opposed end surfaces and comprising an inner layer and at least one outer layer. Equipment is provided for controlling the feeding of metal through the conduits to maintain upper surfaces of metal in different feed chambers at different vertical levels, with a lowermost surface being maintained at a position up to 3 mm above a lower end of the at least one cooled divider wall, or at a position below the lower end where, in use, the surface contacts semi-solid metal issuing from an adjacent feed chamber. Secondary cooling equipment is positioned close to the discharge end opening and has parts positioned adjacent to each of the side walls and end walls of the mold. At least one of the divider walls is movable in the direction of casting. The equipment for controlling the feeding of metal is adjustable to maintain an upper surface of metal in at least one of the feed chambers at a fixed relative position to the at least one divider wall.

Another exemplary embodiment of the invention provides a method of casting a composite ingot made of metals having similar freezing ranges. The method comprises the steps of sequentially casting a generally rectangular composite ingot having at least two metal layers and having opposed side surfaces and opposed end surfaces by passing metals having similar freezing ranges through a mold provided with cooled mold walls and at least one cooled divider wall, thereby subjecting the metals to primary cooling to form the ingot, and then further cooling the ingot following its emergence through a discharge end opening of the mold by applying secondary cooling to the side and end surfaces of the ingot. The secondary cooling is initially applied to at least one of the side surfaces of the ingot at an effective distance from the discharge end opening that is different from an effective distance at which the secondary cooling is initially applied to the end surfaces, to thereby improve adhesion between the metal layers by causing molten metal of a later-cast layer to heat metal of an earlier-cast layer to a temperature within a freezing range of the earlier cast metal upon initial contact therewith.

In the method, the secondary cooling is preferably carried out by projecting streams of water onto the ingot from the side or end walls of the mold, and at least one of the walls of the mold is moved relative to at least one other to create the differences of effective distance of first application of the secondary cooling on the surfaces of the ingot.

Another exemplary embodiment of the invention provides a method of casting a composite ingot made of metals having similar freezing ranges, comprising the steps of sequentially casting a generally rectangular composite ingot having at least two metal layers and having opposed side surfaces and opposed end surfaces by passing metals having similar freezing ranges through a mold provided with cooled mold walls and at least one cooled divider wall, thereby subjecting the metals to primary cooling to form the ingot, and then further cooling the ingot following its emergence through a discharge end opening of the mold by applying secondary cooling to the side and end surfaces of the ingot; wherein said at least one cooled divider wall is movable in said mold in a direction of casting and is positioned to maximize adhesion between said layers of said metals.

The exemplary embodiments are particularly applicable when the metals of adjacent layers of a composite ingot have similar or overlapping freezing ranges. By "overlapping" we mean that a freezing range of one metal may extend partially above or below the freezing range of the other metal, or the freezing range of one metal may lie entirely within the freezing range of the other. Of course, such overlapping ranges may in fact be identical, as when the metals of the two layers are the same. As noted, when co-casting alloys of overlapping freezing ranges, difficulties with layer adhesion and/or casting reliability can be observed. Any amount of freezing range overlap may produce such difficulties, but the difficulties start to become especially problematic when the ranges overlap by at least about 5° C., and more especially by at least about 10° C.

It should be appreciated that the term "rectangular" as used in this specification to describe a mold or ingot is meant to include the term "square". Also, in casting rectangular ingots, casting cavities often have slightly bulbous walls, at least on long side walls, to allow for differential contraction of the metal upon cooling, and the term "rectangular" is also intended to include such shapes.

It should be explained that the terms "outer" and "inner" to describe layers of a composite ingot are used herein quite loosely. For example, in a two-layer ingot, there may be no outer layer or inner layer as such, but an outer layer is one that is normally intended to be exposed to the atmosphere, to the weather or to the eye when fabricated into a final product. Also, the "outer" layer is often thinner than the "inner" layer, usually considerably so, and is thus provided as a thin coating or cladding layer on the underlying "inner" layer or core ingot that imparts its bulk characteristics to the ingot. In the case of ingots intended for hot and/or cold rolling to form sheet articles, it is often desirable to coat both major (rolling) faces of the ingot, in which case there are certainly recognizable "inner" and "outer" layers. In such circumstances, the inner layer is often referred to as a "core" or "core layer" and the outer layers are referred to as "cladding" or "cladding layers".

DETAILED DESCRIPTION OF THE EXEMPLARY EMBODIMENTS

Figure 1:
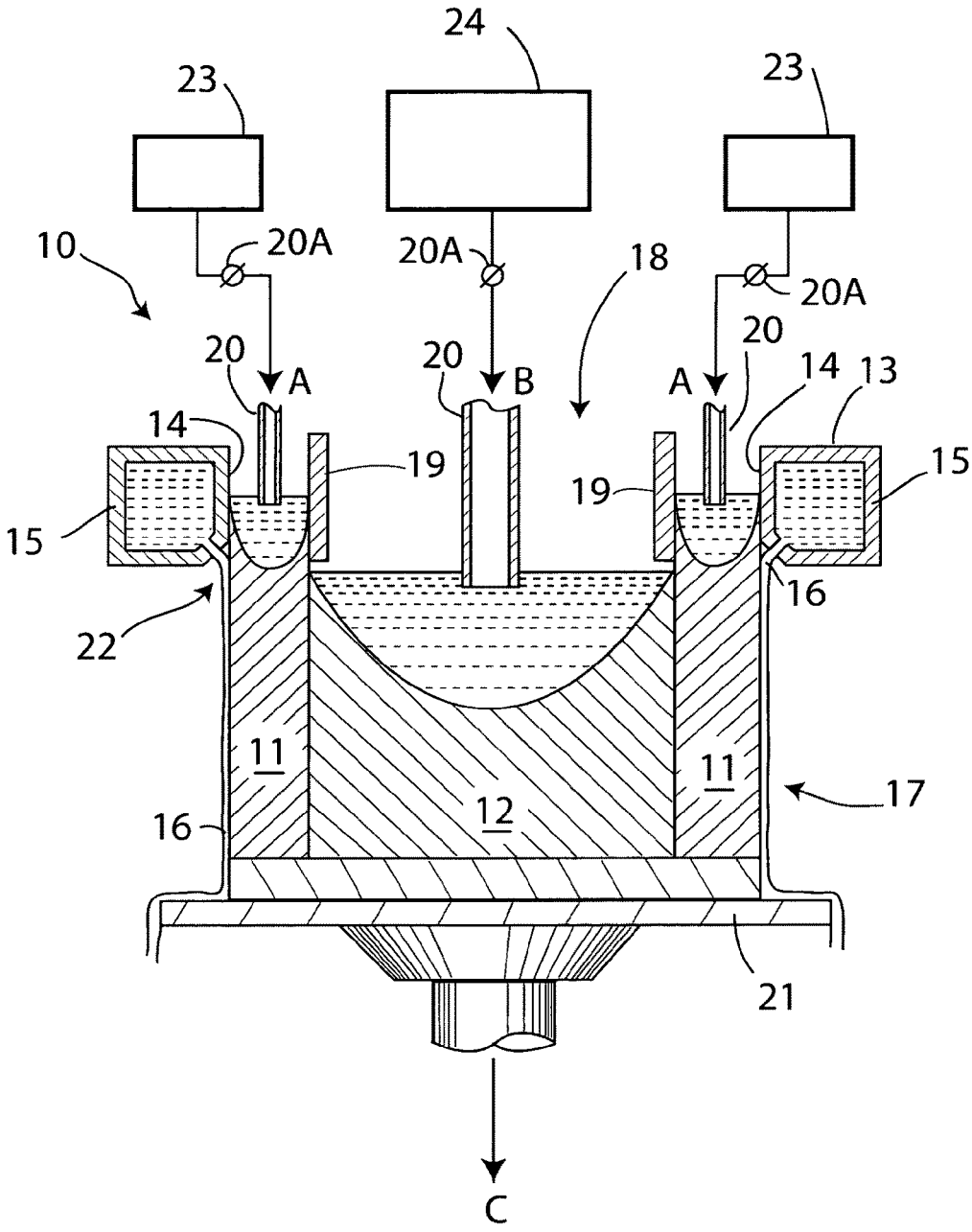
FIG. 1 is a vertical cross-section of a sequential casting mold for casting two coating layers on opposite faces of a core layer, the coating layers being cast first.

The present invention may employ casting apparatus of the general type described, for example, in U.S. Patent Publication No. 2005/0011630, published on Jan. 20, 2005 in the name of Anderson et al. (the disclosure of which is incorporated herein by reference), but modified as described herein. The invention also extends to techniques described in U.S. Pat. No. 6,260,602 to Wagstaff (the disclosure of which is also incorporated herein by this reference).

It is well known that, unlike pure metals, metal alloys do not melt instantly at a particular melting point or temperature (unless the alloy happens to have a eutectic composition). Instead, as the temperature of an alloy is raised, the metal remains fully solid until the temperature reaches the solidus temperature of the alloy, and thereafter the metal enters a semi-solid state (a mixture of solid and liquid) until the temperature reaches the liquidus temperature of the alloy, at which temperature the metal becomes fully liquid. The temperature range between the solidus and liquidus is often referred to as the "freezing range" of the alloy in which the alloy is in a "mushy" state. The apparatus of Anderson et al. makes it possible to cast metals by sequential solidification to form at least one outer layer (e.g. a cladding layer) on an inner layer (e.g. a core layer). The alloy with the higher liquidus temperature is normally cast first (i.e. its upper surface is positioned at a higher vertical level within the mold so that it is subjected to cooling first). As disclosed in the Anderson et al. application, in order to achieve a good bond between the layers, it is desirable to ensure that the surface of the later-cast metal (i.e. the metal surface having a lower position in the mold) is maintained at a position either slightly above (and preferably no more than 3 mm above) the lower end of a chilled divider wall used to restrain and cool the earlier-cast metal, or alternatively slightly below the lower end of the divider wall so that the molten metal contacts a surface of the earlier-cast metal. When first contacted by the molten metal in this way, the outer surface of the earlier-cast metal is preferably semi-solid or is such that it can be re-heated by the molten metal to become semi-solid. It is theorized that the molten metal of the later-cast alloy may mingle (perhaps only to a minor extent in a very thin interfacial zone) with the molten metal content of the earlier cast alloy when the latter is in the semi-solid state in order to achieve a good interfacial bond. At least, even if there is no comingling of molten alloys, certain alloy components may be become sufficiently mobile across the interface that metallurgical bonding is facilitated. This works well when the alloys have widely different freezing ranges, or at least significantly different liquidus temperatures, but difficulties have been found to arise when the freezing ranges of the alloys are similar or overlap and, particularly when the liquidus temperatures are quite close together.

Without wishing to be bound by any particular theory, the problems may arise for the following reasons. In the case of the first-cast alloy, the layer must develop a self-supporting semi-solid or fully solid shell at the surface before the layer moves below the chilled divider wall, although the center of the ingot at this point will generally still be fully liquid. The volume fraction of solid metal in the otherwise molten alloy increases as the temperature falls below the liquidus until it reaches the solidus (where the metal is fully solid). The risk of failure of the self-supporting surface (e.g. rupture of the shell to allow outflow of molten metal from the center) decreases as the volume fraction of metal within the semi-solid zone at the surface increases. If the alloys of the two layers have close liquidus temperatures, the molten metal of the later-cast alloy may contact the surface of the earlier cast alloy at a point where the volume fraction of the latter alloy is relatively slight. The heat from the later-cast alloy may then cause the self-supporting surface to buckle and fail, which in turn requires the entire casting operation to be terminated. There is therefore a delicate balance between having sufficient molten metal in earlier-cast alloy in the contact zone to achieve a good metallurgical bond, but sufficient volume fraction of solid metal to avoid failure of the self-supporting surface, and this balance is more difficult to achieve when the alloys have similar or overlapping freezing ranges than when they do not.

The difficulties encountered during casting may also have something to do with the thermal conductivities of the alloys. Again without wishing to be bound by any particular theory, it is currently believed that the reason for this may be explained as follows. In the direct chill casting process, cooling water contacts the external surfaces of an ingot as it emerges from the mold. This produces an advanced cooling effect, i.e. the outer layer of the ingot becomes cooler sooner (closer to the mold outlet) than it would if no cooling water were applied. Moreover, due to the thermal conductivity of the metal, the cooling water withdraws heat from metal within the mold, i.e. the cooling effect is exerted even higher than the point of initial contact with the cooling water. The magnitude of the advanced cooling effect is a function of the thermal conductivity of the alloy adjacent to the outer surface of the ingot, and the heat removal rate by the cooling water. The advanced cooling effect has been found to have a profound influence on the stability of the interface between the cladding and core layers in the case of alloys having overlapping freezing ranges, especially when the cladding alloys have low relative thermal conductivities. This may be because the interface for such alloy combinations is inherently unstable due to similar temperatures at the initial point of contact between the alloys of the different layers (as explained above), and this is made worse by poor heat removal from the region if the cladding alloy is of low thermal conductivity. In general, it is found that the metals are difficult to cast if the difference of thermal conductivity between the two metals (when in solid form) is greater than about −10 watts/per meter ° K (watt/meter-K).

It is not possible to give precise numerical values to the degree of overlap of the freezing ranges or the differences of liquidus temperatures that produce casting difficulties because this depends to a certain extent on the alloy combinations involved, the physical dimensions of the ingots, the nature of the casting apparatus, the casting speed, etc. However, it is easy to recognize when alloy combinations are suffering from this difficulty because there is then likely to be an increased number of failed casting operations or a decrease of the strength of the interfacial bond in the resulting ingots or rolled products. As an example, casting difficulties are known to arise when alloy AA1200 is first cast as a cladding layer on AA2124 used as a core layer. Alloy AA1200 has a solidus of 618° C. and a liquidus of 658° C., whereas alloy AA2124 has a liquidus of 640° C. Consequently, the freezing ranges overlap and the liquidus temperatures differ by only 18° C. Similarly, there are difficulties when alloy AA3003 is first cast as a cladding layer on alloy AA6111. Alloy AA3003 has a solidus temperature of 636° C. and a liquidus temperature of 650° C., whereas alloy AA611 has a liquidus temperature of 650° C. The difference in liquidus temperatures is thus only 17° C. In cases where the core layer is cast first, difficulties arise when alloy AA2124 (solidus 620° C. and liquidus 658° C.) is used as the core, and alloy AA4043 (liquidus 629° C.) is used as the core. Here, the difference of the liquidus temperatures is 28° C., but difficulties in casting still arise. Other difficult combinations include alloys AA 6063/6061, 6066/6061 and 3104/5083. Incidentally, for an understanding of the number designation system (AA numbers) most commonly used in naming and identifying aluminum and its alloys see "International Alloy Designations and Chemical Composition Limits for Wrought Aluminum and Wrought Aluminum Alloys", published by The Aluminum Association, revised January 2001 (the disclosure of which is incorporated herein by reference).

Surprisingly, the inventors have found that the required balance of casting properties for such difficult alloy combinations can be achieved or restored if the point of first application of the cooling water (secondary cooling) on the face of the ingot adjacent to a core/cladding interface is varied from the point of first application that would normally be employed in the sequential co-casting apparatus. In such apparatus, the cooling water is normally applied at the same height (distance from the mold outlet or the upper surface of the metal pools within the mold) at all points around the cast ingot. In preferred exemplary embodiments, the point of first application of the secondary cooling water is advanced (applied closer to the upper surfaces of the metal pools within the mold) on the face where there is an adjacent underlying metal interface, compared to the cooling at the ends of the ingot or the opposite face of the ingot (if there is no metal interface underlying that surface). That is to say, the cooling water is applied sooner to the cladding face(s) than to the end faces of the ingot and to a non-clad face (if present). The cladding is then cooled to a greater extent before the cladding and core metals meet in the mold (because of the advance cooling effect) than would otherwise be the case in a conventional cooling arrangement, thereby giving greater stability to the interface. However, the extent of the advance of the secondary cooling should not be so great that the cooling of the cladding removes the possibility of achieving contact between molten metal and semi-solid metal at the interface, which is necessary for a strong interfacial bond for the reasons explained above.

FIG. 1 shows an example of an apparatus 10 suitable for sequential co-casting. In this view, the apparatus may appear to be similar to that of the Anderson et al. publication mentioned above, but differences will be apparent from other views shown in other figures. FIG. 1 shows an arrangement in which two outer (cladding) layers are cast before an inner core layer, which is preferred for the exemplary embodiments of the invention, but an alternative arrangement in which the core layer is cast first would also be possible.

Thus, in the illustrated apparatus, outer layers 11 are cast first on the major side surfaces (rolling faces) of a rectangular inner layer or core layer 12. The coating layers 11 are solidified first (at least partially) during the casting process and then the core layer is cast in contact with the semi-solidified surfaces of the outer layers. Normally (although not necessarily), the metal used for the two coating layers 11 is the same, and this metal differs from the metal used for the core layer 12, but the chosen metals are ones that conventionally exhibit poor interfacial adhesion, i.e. ones that have similar or identical or overlapping freezing ranges, with the metal of the outer layers preferably having low thermal conductivity.

The apparatus of FIG. 1 includes a rectangular casting mold assembly 13 that has mold walls 14 forming part of a water jacket 15 for primary cooling from which an encircling stream or streams 16 of cooling water are dispensed for secondary cooling through holes or slots onto the external surfaces of an emerging ingot 17. In FIG. 1, the mold walls are represented by the general numeral 14, but in other views, the mold walls are indicated by numeral 14A, indicating the (normally broader) side walls of the mold, and by numeral 14B, indicating the (normally narrower) end walls of the mold. Ingots cast in such apparatus are generally of rectangular cross-section and normally have a size of up to 70 inches by 35 inches, but may be larger or smaller. The resulting ingots are commonly used for rolling into clad sheet in a rolling mill by conventional hot and cold rolling procedures. As already mentioned, it is important to obtain a good degree of adhesion between the inner and outer layers of the ingot so that layer separation does not occur during casting, rolling or use of the product. It is also, of course, important to avoid casting failure due to rupture or collapse of the interface.

The entry end portion 18 of the mold is separated by divider walls 19 (sometimes referred to as "chills" or "chill walls") into three feed chambers, one for each layer of a three-layer ingot structure. The divider walls 19, which are often made of copper for good thermal conductivity, are chilled (i.e. cooled) e.g. by means of chilled-water cooling equipment (not shown) contacting the divider walls above the levels of the molten metal surfaces. Consequently, the divider walls cool and solidify the molten metal that comes into contact with them. Similarly, the mold walls 14, which are also water-cooled, cool and solidify molten metal that comes into contact with them. The combined cooling provided by both the mold walls and the divider walls is referred to as "primary" cooling of the metal because it is the cooling most responsible for creating an embryonic solidified ingot that emerges from the mold and because it is the cooling that the metal first encounters as it passes through the mold. As indicated by arrows A, the two side chambers are supplied with the same metal from metal reservoirs 23 (or a single reservoir) and, as indicated by arrow B, the central chamber is supplied with a different metal from a molten metal reservoir 24. Each of the three chambers is supplied with molten metal up to a desired level (vertical height) via separate molten metal delivery nozzles 20 each equipped with an adjustable throttle 20A to maintain the upper surface of the molten metal at a predetermined height throughout casting operation. A vertically movable bottom block unit 21 initially closes the open lower end 22 of the mold, and is lowered during casting (as indicated by the arrow C) after a start-up period while supporting the embryonic composite ingot 17 as it emerges from the mold.

In a conventional arrangement for casting in this kind of apparatus, the streams 16 of cooling water are all first contacted with the ingot at the same vertical height on all faces and ends of the ingot. The position of first contact is often the same as that used for casting a monolithic (single layer) ingot and is intended to stabilize the solid outer shell of the ingot as it emerges from the mold, but there is normally a space or gap between the bottom of the mold and the point of first contact of the cooling water. The conventional position of first contact may be regarded as the "benchmark height" of secondary cooling of the mold. The mold walls 14 are generally of the same height around the mold and, as noted, the openings for the water streams 16 are positioned a short distance below the bottom of each mold wall and are aligned with each other at the same vertical height.

Figure 2:
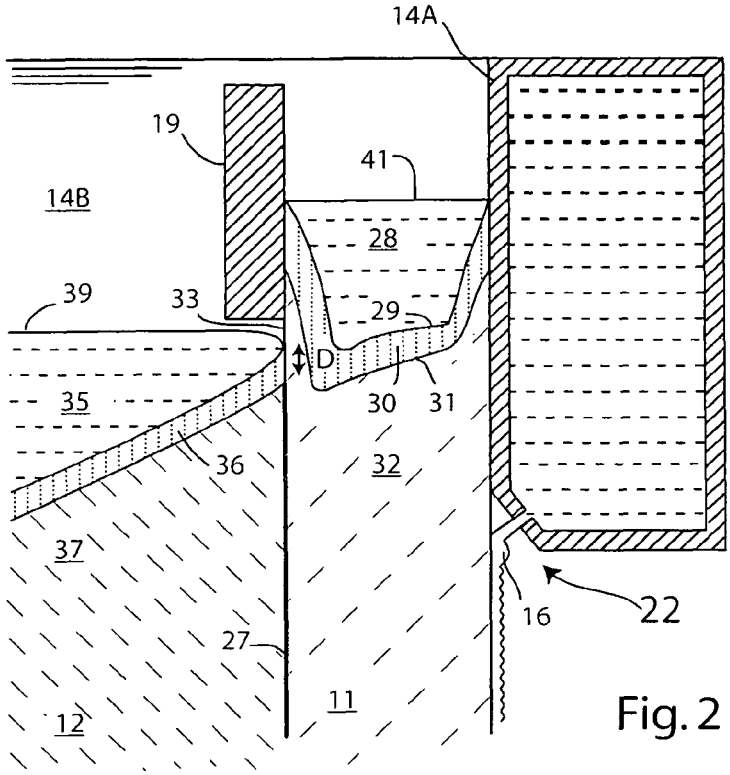
FIG. 2 and FIG. 3 are enlarged partial sections of the apparatus of FIG. 1, but showing one side wall of the mold in a "benchmark" position (FIG. 2) and in a raised position (FIG. 3)

FIG. 2 is a detailed cross-sectional view of the right hand side of the apparatus of FIG. 1. This view shows that sidewall 14A (the wall adjacent to one of the major rolling faces of the ingot) of the mold is aligned vertically with end walls 14B, so that secondary cooling commences at the same vertical height on all faces and ends of the ingot. As molten metal is fed into the side compartment formed between divider wall 19 and side wall 14A, it forms a layer having a molten metal pool or sump 28 that cools around the lower and outer sides to form a semi-solid (mushy) zone 30 and eventually a solid region 32. The mushy zone is bounded by a surface 29 where the temperature of the metal is at the liquidus and a surface 31 where the temperature is at the solidus. The upper level 41 of the metal is higher than the upper level 39 of the metal of the core present in the central compartment of the mold and, in fact, the level 39 is below the lower end of the divider wall 19, as shown. The metal of the core itself forms a molten sump 35, a semi-solid zone 36 and a solid zone 37. The molten metal 35 and semi-solid zone 36 of the core 12 contacts a surface 33 of the outer layer 11 over a region D indicated by the double-headed arrow. For proper bonding between the layers, the surface 33 should be sufficiently self-supporting to avoid collapse of the interface 27 between the metal layers, which (if it occurred) would allow unrestricted intermingling of molten metals from the compartments and failure of the casting operation. However, the temperatures of the respective metals should be such that molten metal of the core contacts semi-solid metal of the outer layer, possibly by reason of the molten metal of the core heating the metal of the outer layer to a temperature between its solidus and liquidus temperatures. In the arrangement of FIG. 2, the molten sumps 28 and 35 and semi-solid zones 30 and 36 are quite close to each other (perhaps 4-8 mm apart) and there is a risk of a breach of the interface if the freezing ranges of the metals overlap and heat cannot be withdrawn quickly through the outer layer 11 because of its low thermal conductivity. Heat from the outer layer is of course extracted from the outer layer partly by the primary cooling water behind the mold wall 14A itself, as well as the cooling imparted by the divider wall 19, and partly by the secondary cooling from the streams 16 of cooling water. Although the streams are contacted with the ingot below the region D, the temperature of this region, and the shape and depth of the sump 28, is nevertheless affected by the cooling water because heat is extracted downwardly through the outer layer 11.

Figure 3:
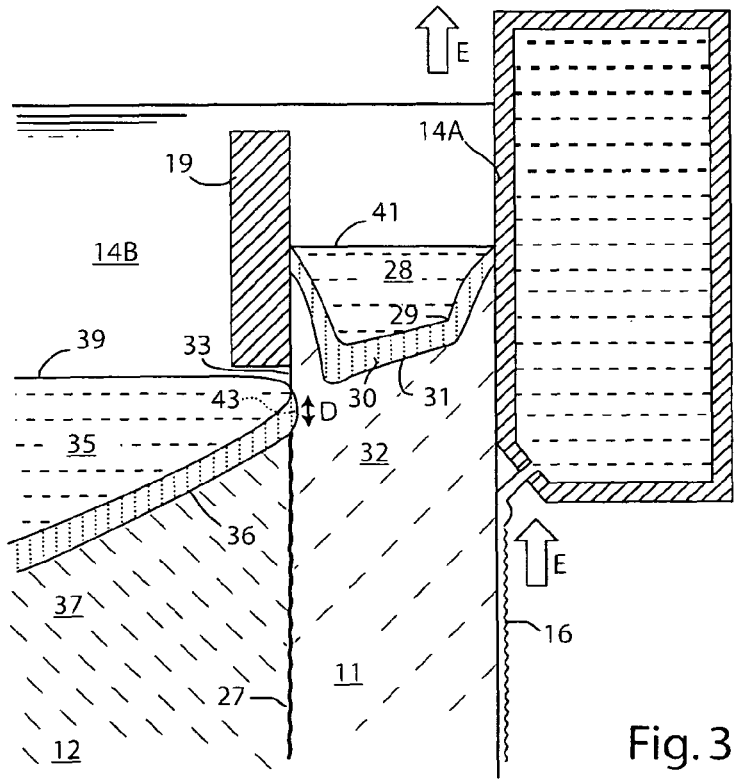

FIG. 3 shows a variation in which mold wall 14A has been raised relative to the end walls 14B by a distance E. This has the affect of raising the secondary cooling streams 16 so that they are applied to the ingot sooner (closer to the upper metal surface 41) than is the case for the arrangement of FIG. 2. The source of this cooling is therefore closer to the sump 28 and provides greater cooling for this part of the ingot. As a result, the sump 28 becomes more shallow than is the case for FIG. 2, as illustrated in the drawing. This means that the distance between the molten metal 35 of the core and the molten metal 28 of the outer layer is greater in the arrangement of FIG. 3, so the risk of collapse of the interface 27 is much less. However, the temperature of the solid metal 32 of the outer layer at surface 33 in the region D is still sufficiently high that the molten metal 35 of the core may re-heat the surface 33 to create a small region of semi-solid metal as illustrated by region 43 (which may, for example, be merely 50-200 microns deep). The desired good interfacial bond can therefore be achieved. If the wall 14A is raised even further, there is a risk that the metal 32 will be cooled so much at surface 33 by the effect of the cooling water streams 16 that the region 43 of semi-solid metal will not be formed, and the desired strong interfacial bond will again not be achieved. The movement of the walls in this way does not produce a significant difference to the effect of primary cooling, so the impact is primarily on the effect of secondary cooling created by water streams 16. The distance E by which the wall 14A should be raised in any particular case depends on several factors, particularly the characteristics of the metals of the core and the outer layer. The optimum distance may be determined for any combination of alloys by trial and experimentation. Often, for many alloy combinations, it is found that the distance E is in the range of 0.25 to 1.0 inch, and is commonly in the range of 0.25 to 0.50 inch.

For an ingot having an outer cladding layer 11 on both sides, as shown in FIG. 1, the mold walls at both faces of the ingot would be raised to achieve the desired bonding on both sides of the ingot. The end walls would remain in their original position. If the metals of the two outer layers are the same, the distance by which the walls will be raised is the same on both sides of the mold. If the metals of the two outer layers are different, the distance by which the sides are raised may be somewhat different to achieve an optimum effect. For an ingot having a cladding layer on only one side, only the mold wall on that side will be raised, and the mold wall on the opposite side will remain unmoved, thereby dispensing cooling water streams 16 at the same height as the cooling water applied to the ends of the ingot.

As an alternative to raising the side walls 14A, the end walls 14B may be lowered to achieve the same effect (the secondary cooling adjacent the side walls 14A is elevated relative to the secondary cooling of the end walls 14B). In such cases, the divider walls 19 would remain in the same positions and would therefore not be fixed to the end walls of the mold. As a still further alternative, it is possible to lower divider walls 19 within the mold (together with the surface 39 of the core metal and the surface(s) 41 of the cladding metal) while maintaining all the side walls and end walls at the "benchmark" height. The surfaces of the core and cladding remain at the same relative heights as in a conventional molding operation, but the molding operation takes place lower in the mold, so the secondary cooling occurs higher (closer to the molten metal surfaces) than would otherwise be the case. This again has the same effect as raising the position of first application of the secondary cooling stream relative to the region D. In such a case, secondary cooling may be applied at the same height around the mold. If there is a cladding on only one side of the ingot, the divider wall 19 may be lowered on that side and the sidewall 14A on the other side may be lowered to compensate for the lower level of core metal on that side.

It should be kept in mind that the situation represented in FIGS. 2 and 3 is just one example of how the adhesion between the layers can be affected by adjusting the position of first application of the secondary cooling around the ingot. Other situations may arise depending on the various factors. For example, there may be situations where the point of first application of the secondary cooling on the coated faces of the ingot should be moved down relative to that of the end faces, rather than up as shown in FIGS. 2 and 3. For example, if the sump of the coating layer is too shallow at the conventional position of first application, it may be desirable to move the secondary cooling down to lower the sump, thereby assuring a suitable temperature of the surface 33 to allow the formation of a zone 43.

As a still further alternative, the mold 10 may be designed to have fixed but different secondary cooling heights around the mold. This may be suitable for a mold designed for casting a particular alloy combination and that would be unlikely to be used for other alloy combinations. The variation of cooling height around the mold could therefore be built into the design based on prior experience with casting such a combination. For example, the streams 16 may be arranged at different angles one or two opposite sides compared to the angle used for the mold end walls.

Figure 4:
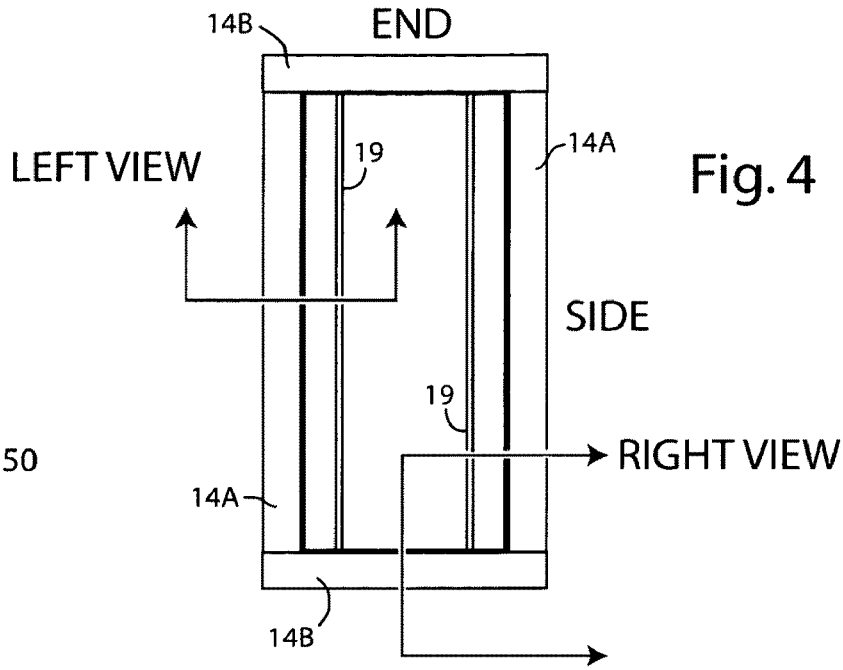
FIG. 4 is a schematic view representing a top plan of a casting mold illustrating a view shown in FIG. 5.
Figure 5:
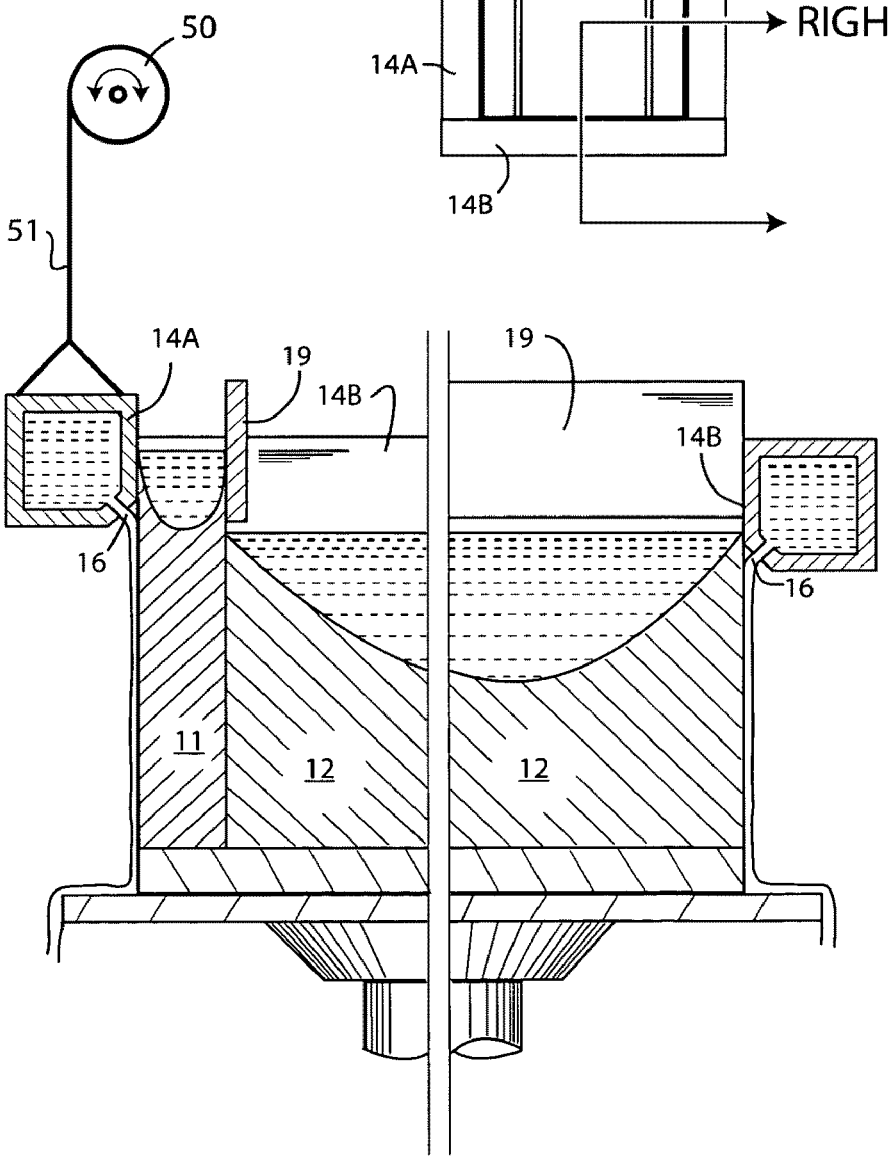
FIG. 5 is a split vertical cross-section of sequential casting molds showing different relative heights of the mold walls at the faces and ends of the mold.

FIGS. 4 and 5 indicate how the positions of secondary cooling may be varied. FIG. 5 is a split view of the sequential casting mold and can be best understood with reference to FIG. 4, which is a plan view of a rectangular mold similar to FIG. 1 showing end walls 14B, side walls 14A and dividing walls 19. The two sets of section arrows of FIG. 4 indicate, respectively, the view shown on the left hand side of FIG. 5, and the views shown on the right hand side of FIG. 5. Consequently, the left hand side of the split views shows the primary and secondary cooling at the side faces 14A of the mold (both side faces are the same), and the right side shows the primary and secondary cooling at the end faces 14B of the mold (both end faces are the same). FIG. 5 shows a mold in which the coating layer 11 is cast first.

In the case of FIG. 5, the mold walls 14A at the side of the ingot are raised above those 14B at the ends of the ingot. The mold walls 14B at the ends of the ingot are positioned such that the secondary cooling is at the "benchmark height". The secondary cooling apparatus (water streams 16) are positioned at different heights along the ingot sides relative to the ingot ends, and this causes the desired adjustment of the positions of the solidification zones (liquid to semi-solid, and semi-solid to solid) in the respective layers of the ingot, thereby providing localized semi-solid fusion and a good adhesion between the layers.

Figure 6A:
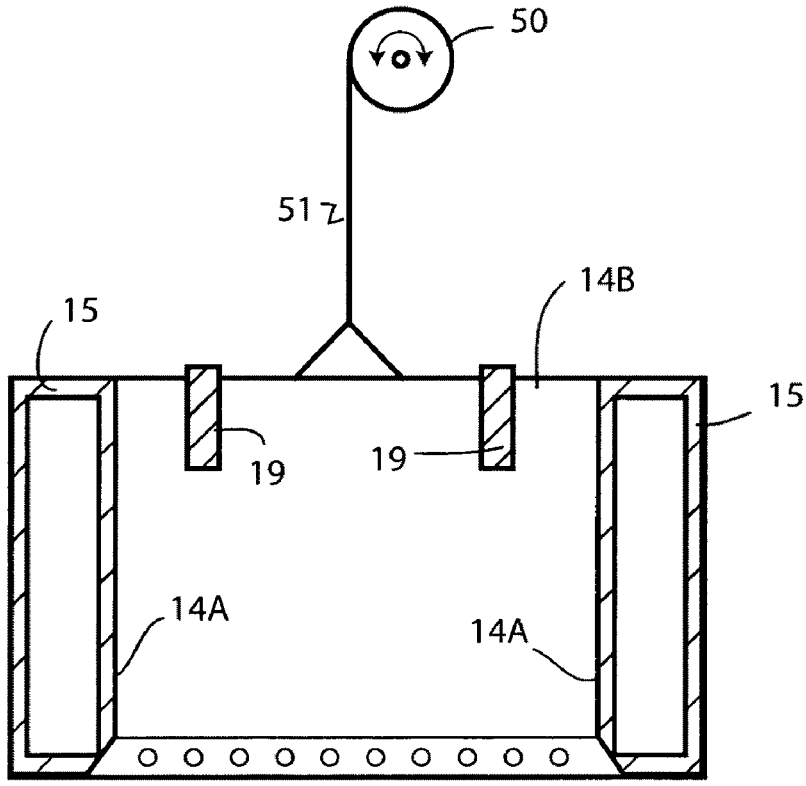
FIGS. 6A and 6B are simplified cross-sectional sketches of a mold showing the relative movement of the side walls of the mold.
Figure 6B:
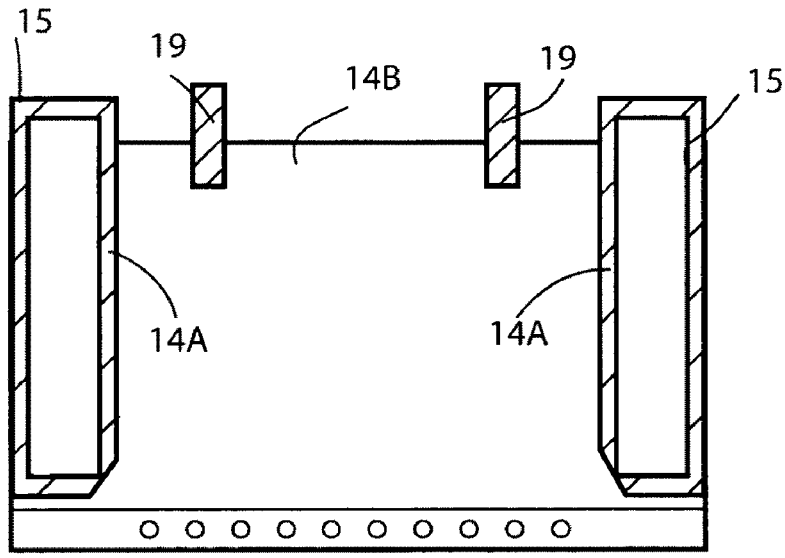

In the illustrated embodiments of FIGS. 2, 3, 4 and 5, the mold has side walls that can be moved relative to the end walls of the mold which may be fixed in place. As already noted, rather than raising the side walls, an equivalent effect may be achieved by lowering the end walls while keeping the side walls fixed. This is shown in FIGS. 6A and 6B. In the case of FIG. 6A, the end wall 14B is at the same height as side walls 14A, but in FIG. 6A end wall 14B has been lowered relative to end walls 14A. In this embodiment, the end walls 14B at both ends of the mold would be moved by the same distance, and this would be done most preferably when the mold was configured to provide outer cladding layers on both sides of the ingot. The end walls 14B of the mold may be suspended between the side walls 14A, e.g. to allow the size of the cast ingot to be varied (by sliding the end walls in or out between the side walls). The relative heights of the side and end walls may be adjusted by raising the end walls 14B (e.g. by winch 50 and cable 51 as indicated).

In all of these embodiments, the movable walls must be adjustable in height without allowing leakage of molten metal from the mold at the points where the walls contact each other. Suitable seals (not shown) may be provided between the walls of the mold for this purpose. Generally, one or one pair of walls (e.g. the end walls) may be fixed in place and the other pair (e.g. the side walls) may be movable down and/or up. Alternatively, all four walls of the mold may be independently vertically adjustable. Any suitable means may be provided for supporting and vertically moving the walls, e.g. hydraulic or pneumatic cylinder and piston arrangements, or supports incorporating rotatable vertical bars provided with screw threads that pass through threaded eyelets on the outer surfaces of the mold walls. FIG. 5 and FIG. 6A show a representation of another such means, i.e. a rotatable winch 50 and cable 51.

In still further alternative embodiments, the position of first application of the cooling water may be adjusted by means other than raising or lowering sidewalls or end walls of the mold. For example, in some molds, each side of the mold is provided with a double row of holes for producing jets of cooling water (e.g. as disclosed in U.S. Pat. No. 5,685,359 to Wagstaff, the disclosure of which is incorporated herein by reference). One set of holes produces jets angled differently from the other set of holes, so that the jets contact the ingot at different heights. The two sets of jets applied together produce an average cooling height, but this can be changed (moved upwardly) by blocking the holes that form the lower set of water jets.

Of course, it is really the relative movement of the secondary cooling means on different sides of the ingot that is important for some exemplary embodiments of the invention. In certain embodiments, therefore, the mold walls may be kept immovable relative to each other, and the secondary cooling means may be independent of the mold walls (e.g. cooling water sprays fed by pipes positioned below the cooling walls, and means may be provided for independently raising and/or lowering parts of the secondary cooling means adjacent to one or more sides of the mold). However, since it is usual in casting equipment of this kind to supply the secondary cooling streams from holes or slots formed in the water jacket used for the primary cooling, moving of the mold walls is normally preferred.

In still alternative exemplary embodiments, instead of moving the mold walls or the cooling means as such to vary the vertical position of the first application of the secondary cooling around the mold, the angles of ejection of the cooling liquid may be varied around the mold. If the cooling streams are projected closer to the emerging ingot in the direction of casting before they contact the ingot surface, their point of first contact will be closer to the discharge end outlet of the mold. Likewise, if the cooling streams can be projected further from the bottom end of the mold, the point of first application can be effectively lowered. It may be desirable to make the angle of ejection variable around the mold so that the height of first contact on particular sides or ends of the ingot can be varied at will and the optimum position employed for any particular metal combination.

Figure 7:
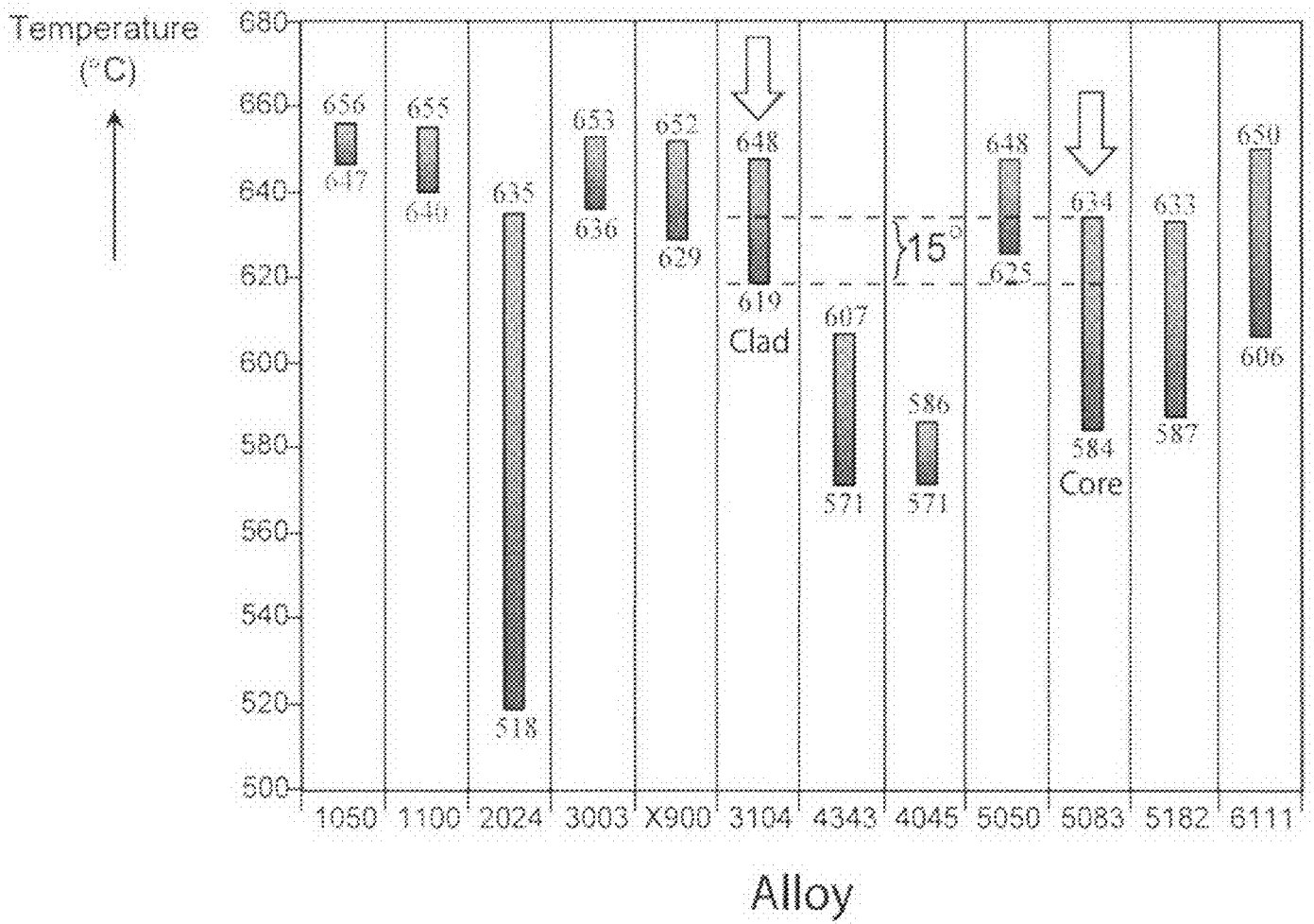
FIGS. 7 and 8 are charts showing the freezing ranges of various aluminum alloys.
Figure 8:
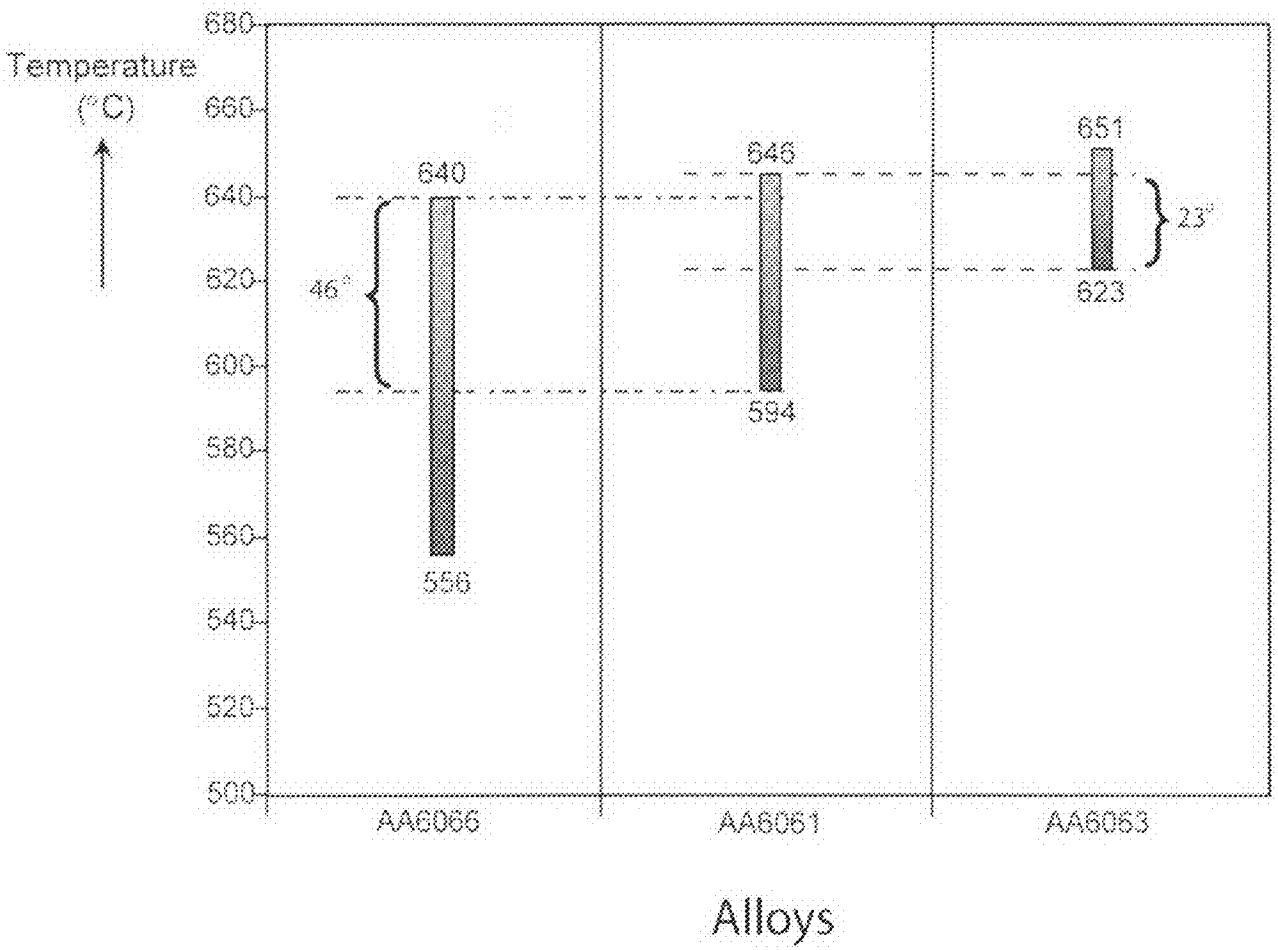

FIGS. 7 and 8 are charts showing the freezing ranges of various aluminum alloys. It was mentioned earlier that examples of alloy combinations suitable for use in the exemplary embodiments may include aluminum alloys 3104/5083, 6063/6061 and 6066/6061 (in which the cladding is given first). FIG. 7 shows various alloys but includes alloys 3104 and 5083 of the first combination (marked by arrows). It will be seen that these alloys have freezing ranges that overlap by 15° C. FIG. 8 shows the freezing ranges of alloys 6066, 6061 and 6063. The combination 6063/6061 overlap by 23° C., and the combination 6066/6061 overlap by 46° C.

What we claim is:

1. Apparatus for casting a composite metal ingot, comprising:

an open-ended generally rectangular mold cavity having an entry end portion, a discharge end opening, cooled mold walls surrounding the mold cavity to form opposed side walls and opposed end walls of the mold, and a movable bottom block adapted to fit within the discharge end and to move axially of the mold in a direction of casting;

at least one cooled divider wall at the entry end portion of the mold to divide the entry end portion into at least two feed chambers;

a conduit for feeding metal for an inner layer to one of the at least two feed chambers and at least one conduit for feeding metal for at least one outer layer to at least one other of the feed chambers, to thereby form a generally rectangular ingot at the discharge end opening having opposed side surfaces and opposed end surfaces and comprising an inner layer and at least one outer layer;

equipment for controlling the feeding of metal through said conduits to maintain upper surfaces of metal in different feed chambers at different vertical levels, and secondary cooling equipment adjacent to the discharge end opening having parts positioned adjacent to each of said side walls and end walls of the mold, wherein parts of said cooling equipment adjacent to said end walls are arranged to commence said secondary cooling at a different position along said ingot in the direction of casting relative to said parts of said secondary cooling equipment adjacent to at least one of said side walls.

2. The apparatus of claim 1, wherein said equipment for controlling the feeding of metal is operable to position a lowermost surface up to 3 mm above a lower end of said at least one cooled divider wall, or to position said lowermost surface below said lower end such that, in use, said surface contacts semi-solid metal issuing from an adjacent feed chamber.

3. The apparatus of claim 1, wherein the parts of the secondary cooling equipment adjacent to said end walls are configured to commence secondary cooling at a different position along said ingot relative to said parts of the secondary cooling equipment adjacent to both of said side walls.

4. The apparatus of claim 1, wherein the parts of the secondary cooling equipment are supported by each of the side walls and end walls of the mold, and at least one of the side walls is movable in the direction of casting relative to other side walls or end walls of the mold.

5. The apparatus of claim 1, wherein the parts of the secondary cooling equipment are supported by each of the side and end walls of the mold, and the opposed end walls are movable in the direction of casting relative to at least one side wall of the mold.

6. The apparatus of claim 1, wherein the cooled mold walls are surrounded by a jacket containing cooling liquid, and the secondary cooling equipment comprises apertures in the jacket adjacent to the discharge end opening of the mold for projecting streams of the cooling liquid onto the surfaces of the ingot.

7. The apparatus of claim 1, wherein the at least one of the parts of the secondary cooling equipment is movable by an amount in the range of 0.25 to 1.0 inch in the direction of casting.

8. The apparatus of claim 1, wherein the equipment for controlling the feeding of metal is connected to reservoirs containing molten metals having overlapping freezing ranges.

9. The apparatus of claim 1, wherein the equipment for controlling the feeding of metal is connected to reservoirs containing molten metals that, when solid, differ in thermal conductivity by greater than −10 watts/per meter ° K.

10. The apparatus of claim 1, wherein the secondary cooling equipment is configured such that secondary cooling of the end surfaces of the ingot commences at a benchmark position of the mold, and the secondary cooling of the at least side surface commences at a position other than the benchmark position.

11. A method of casting a composite ingot made of metals having similar freezing ranges, comprising the steps of:

sequentially casting a generally rectangular composite ingot having at least two metal layers and having opposed side surfaces and opposed end surfaces by passing metals having similar freezing ranges through a mold provided with cooled mold walls and at least one cooled divider wall, thereby subjecting the metals to primary cooling to form the ingot, and then further cooling the ingot following its emergence through a discharge end opening of the mold by applying secondary cooling to the side and end surfaces of the ingot;

wherein the secondary cooling is applied to at least one of the side or end surfaces of the ingot at a different position along the ingot from the position(s) at which the cooling water is applied to at least one other of said surfaces.

12. The method of claim 11, wherein metals are supplied to form an ingot having an inner layer and two outer layers, and wherein secondary cooling of the surfaces of the two outer layers is commenced at a different position in a direction of casting from a position at which secondary cooling of the ends of the ingot is commenced.

13. The method of claim 11, wherein the secondary cooling of the side surfaces is varied in a direction of casting to maximize adhesion between the layers.

14. The method of claim 11, wherein the effective distance at which secondary cooling of the at least one side surface differs from the effective distance at which secondary cooling of the end surfaces commences by an amount in the range of 0.25 to 1.0 inch.

15. The method of claim 11, wherein secondary cooling of the end surfaces commences at a benchmark position for the mold, and secondary cooling of the at least one of the side surfaces at a position different from the benchmark position.

16. The method of claim 11, wherein the secondary cooling is carried out by projecting streams of water onto the ingot from the walls of the mold, and at least one of the walls of the mold is moved relative to at least one other to create the differences of effective distance of first application of the secondary cooling on the surfaces of the ingot.

17. The method of claim 11, wherein said metals are selected to have a difference of thermal conductivity when solid of greater than −10 watts/per meter ° K.

18. The method of claim 11, wherein said metals are selected to have overlapping freezing ranges.

* * * * *